United States Patent [19]

Jullien

[11] 4,274,638

[45] Jun. 23, 1981

[54] GAME SWITCH MATRIX

[75] Inventor: Graham A. Jullien, Windsor, Canada

[73] Assignee: James J. Oqilvy, Windsor, Canada

[21] Appl. No.: 952,736

[22] Filed: Oct. 19, 1978

[30] Foreign Application Priority Data

Nov. 14, 1977 [CA] Canada ..... 290796

[51] Int. Cl.[3] ..... A63F 3/08

[52] U.S. Cl. ..... 273/238; 200/61.1; 200/159 B; 200/340; 200/278; 273/269; 273/138 A

[58] Field of Search ..... 273/238, 269, 138 A; 200/61.1, 61.11, 86 R, 1 R, 5 H, 46, 159 B; 35/9 C, 9 D

[56] References Cited

U.S. PATENT DOCUMENTS

| | | | |
|---|---|---|---|
| 2,594,434 | 4/1952 | Hofsetz | 273/238 |
| 3,300,217 | 1/1967 | Franklin | 273/238 |
| 3,308,253 | 3/1967 | Krakinowski | 200/86 R |
| 3,668,337 | 6/1972 | Sinclair | 200/5 A |
| 3,732,389 | 5/1973 | Kaelin et al. | 200/1 R X |
| 3,960,044 | 6/1976 | Nagai et al. | 200/159 B X |

OTHER PUBLICATIONS

"Scanning Switch", K. A. Brooks, and L. C. Stanley, *IBM Technical Disclosure Bulletin,* vol. 10, No. 9, Feb. 1968, p. 1421.

*Primary Examiner*—Richard C. Pinkham
*Assistant Examiner*—Scott L. Brown
*Attorney, Agent, or Firm*—Craig and Antonelli

[57] ABSTRACT

A game switch particularly useful as a bingo table used by a bingo caller has greatly increased reliability over conventional microswitch actuated tables. A matrix of conductive flexible strips are used, whereby when a ball is depressed at an intersection of a vertical and horizontal strip, a contact is made. The resistance of the contact is particularly suitable for use with CMOS gate inputs to an electronic matrix position determining circuit.

8 Claims, 7 Drawing Figures

GAME SWITCH MATRIX

This invention relates to a switch matrix which is particularly useful for the game of bingo, particularly of the electronic kind.

In a game such as bingo, numbers are selected at random, and the numbers are called out to the players of the game. Thse numbers are then located on cards by the players, and after a row or other sequence of numbers is found by one of the players, that player is declared a winner. In the form of game in which there are a large number of players and a large number of successive games, the selection of numbers at random is usually obtained by use of an air blower chamber. Balls which are light of weight carry the numbers to be called and are the stream of air in the blower chamber and are mixed randomly. Individual numbers are then selected as the balls are blown into an exit tube.

The caller of the game then selects each ball in sequence from the exit tube, calls the number, on the ball, and places the ball in the corresponding numbered hole of a table. The ball is depressed, and a microswitch is thereby actuated, causing the corresponding number on a display indicator board to light up. A spring holds the ball in the hole, thereby retaining the microswitch actuated. It has been found that the microswitches commonly break down and are a frequent source of trouble, requiring fairly frequent servicing. Usually the microswitches carry the full current required to illuminate the light bulb of the display, and therefore repeated opening and closing of the microswitch contacts eventually causes their deterioration, resulting in a lack of reliability of the display. Since the game of bingo in many localities is controlled by law, an operator calling a number which is not displayed risks reprimand from the authorities.

Accordingly, it is desirable to have apparatus which enables display of the called numbers which does not exhibit the aforenoted breakdown and maintenance problems, and does not cause difficulties for the players of not displaying the called number, resulting from inoperative microswitches.

I have invented a table top for retaining the randomly selected numbered balls and which provides greatly increased reliability of operation. No microswitches are used nor high-current carrying contacts, and the electrical contact which is made is only momentary, and as a result there is a significantly improved reliability of operation of the apparatus.

The present invention is intended to be used in an electronic form of game, by which only a single momentary contact is required to designate which number is to be illuminated on the display board. Furthermore, each number in the present invention is designated by row and column. My invention of an electronic form of game apparatus is described in Canadian Patent Application Ser. No. 290,796, dated Nov. 14, 1977, by Graham A. Jullien.

Broadly, my invention is a game switch matrix comprising a plurality of first spaced parallel strips of conductive, flexible resilient material, and a plurality of second parallel strips of conductive material disposed orthogonal to, below, in a plane parallel to, and spaced from the first plurality of strips. The invention also includes means for supporting the first plurality of strips, whereby, upon depression of one strip of the first plurality of strips at a point adjacent one strip of the second plurality of strips, only those adjacent strips adjacent the point of depression are caused to make electrical contact, and the strip which had been depressed is restricted from contacting any other of the second plurality of strips.

In normal usage in the game of bingo, a ball is used to depress the upper strip of flexible resilient material, which is caused to contact the underlying orthogonal strip of material. Since I prefer to use CMOS gates at the input to my electronic circuit, which gates have their input terminals respectively connected to the individual rows or columns of conductive material, (and the columns or rows individually driven by DC or other signals), series resistance up to several hundred kilohms is acceptable (and indeed desireable) for operation of the CMOS gates. Very little current is drawn, and upmost longevity of lifetime of the contact is achieved.

In a second embodiment of the invention, the game switch is comprised of a plurality of spaced parallel conductive strips adherent to a support. Each of the strips is dimpled upwardly across its width, at regularly spaced intervals, so as to leave a gap between each dimpled portion and the support. Conductive terminals are disposed directly under each of the dimpled portions above the support, spaced from the underside of each dimpled portion. Further means interconnects predetermined ones of conductive terminals, preferably in rows. Each dimpled portion can be pushed downwardly to electrically connect with the associated terminal therebelow, and recover its dimpled condition after pushing pressure has be released.

The description herein is directed to a game of bingo, although it is not intended to be restricted thereto; other applications will become obvious to those skilled in the art.

Better understanding of the invention will be obtained by reference to the description below, and to the following drawings in which.

Figure 1:
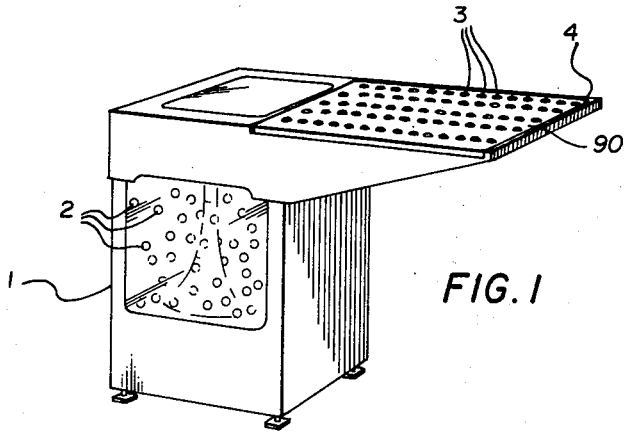
FIG. 1 is a perspective view of a typical bingo apparatus as utilized by a bingo caller.

Turning now to FIG. 1, a bingo game console is shown. The console consists of a blowing chamber 1, within which are disposed a plurality of balls 2, which are light in weight such as ping-pong balls, each carrying a number. A fan blows the balls within the blowing chamber 1, causing constant mixing and randomization of the balls. An outlet tube of well-known construction (not shown) collects individual balls, which are retained in a row. The caller selects each ball in sequence and announces the number over a public address system.

The ball is then placed into a correspondingly numbered hole 3 of a table top 4. The table top retains the balls in position where the numbers can be viewed by the operator.

When placed in the appropriate hole 3 the ball is pushed downwardly and is caused to depress a microswitch in the prior art, and is maintained in position by a spring or similar structure. Current flowing through each depressed microswitch causes illumination of a correspondingly numbered and series connected light bulb located at the rear of a number, on a display board. As was noted earlier, due to the construction of the microswitch the frequency of use and the relatively heavy current flowing through its contacts, each microswitch is subject to failure after a period of time. This causes unreliability at random times, once it begins to deteriorate.

The present invention is directed to a replacement for table top 4, and is useful with the type of game which can electrically register the number on the ball by recognizing the specific crosspoint which is temporarily closed within a game switch matrix.

Figure 2:
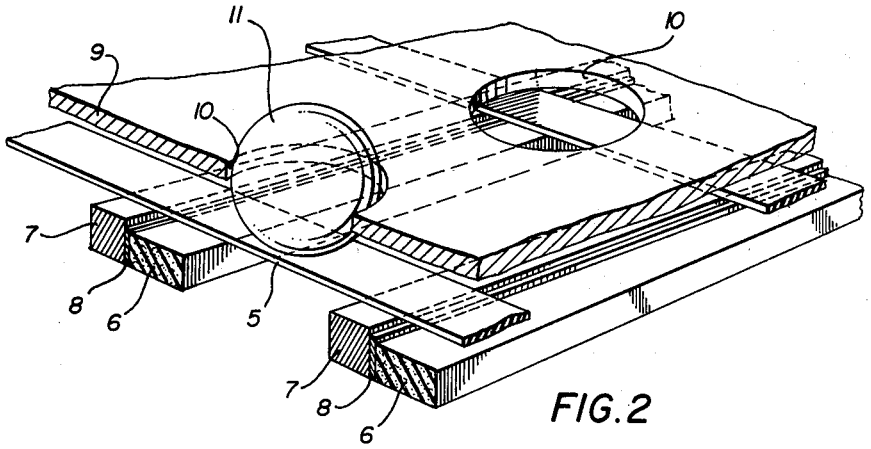
FIG. 2 is a sectional view, in perspective and in X-ray of a portion of the switch structure which is the subject of the invention.
Figure 3A:
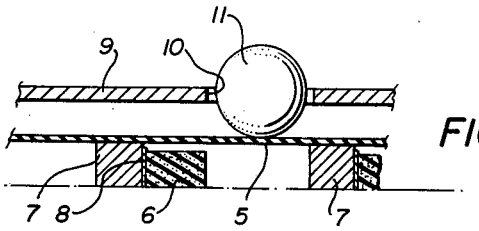
FIGS. 3A and 3B are elevation views in section of the inventive switch in stages of operation.
Figure 3B:
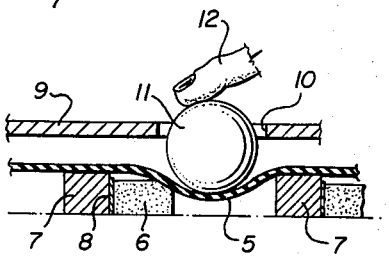

Turning now to FIGS. 2, 3A and 3B, the preferred embodiment of invention is illustrated in detail. A plurality of first spaced parallel strips of conductive flexible resilient material, such as conductive rubber forms either the rows or columns of the matrix. One of the strips 5 is shown exposed for clarity of illustration.

Disposed below and spaced from the conductive rubber strips 5 are orthogonal strips 6, preferably fabricated of conductive yieldable resilient material. The strips 6 are fabricated preferably of conductive foam material, although other conductive materials such as metal can be used in place. However, it is preferred that the material be yieldable and resilient in order to minimize mechanical wear.

The conductive foam is available from the Japan Chemical Company, Toronto, Ontario, and the conductive rubber is available from Chomerics Inc., of Woburn, Mass.

Supporting the conductive rubber strips are insulating strips 7, which are greater in height than the conductive foam strips. Preferably the insulating strips are fabricated of wooden blocks. These are disposed alongside each of the conductive foam strips 6, in an orthogonal direction to the conductive rubber strips 5.

It is also preferred to locate highly conductive flexible strips of material such as foil strip 8 in contact with and along the edges of each of the conductive foam strips 6. In the embodiment shown in FIGS. 2, 3A and 3B, the foil strips are sandwiched between insulating strips 7 and conductive foam strips 6.

It may be seen that upon depressing conductive rubber strip 5 at a given generally central location between insulating strips 7, strip 5 will be caused to deflect or depress, and will touch conductive foam strip 6. An electrical contact is thereby made.

Terminals are located at an end of each of the rubber strips, as well as at the end of each of the foil strips 8. Current will pass between conductive rubber strip 5 and the conductive foil strip through the conductive foam strip which is below the point of depression, and which is located between the two insulating strips 7. Due to the support by the insulating strips, the conductive rubber strip will be prohibited from making contact to any other conductive foam strip than the one adjacent the point of depression.

A table top 9 is located above, and is spaced from the upper surface of the conductive strips 5. Holes 10 are located within the table 9 which are sufficiently large to accommodate the passage through of a ball such as a ping-pong ball 11 without interference. Typically, such balls are about 1 1/16 inch in diameter, and the holes may be 1 3/16 inches in diameter. The space between the lower surface of the strips 5 and the upper surface of strips 6 typically is preferred to be about 1/16 inch.

In operation a ball 11 is placed within a correspondingly numbered hole 10. The ball is gently pushed by the finger 12 of the operator. This causes deflection of conductive rubber strip 5, into contact with the conductive foam strip 6. Insulating strips 7 retain the conductive rubber strips 5 normally spaced from the conductive foam strips 6, and they also cause deflected rubber strip 5 not to deflect so as to contact more than the intended individual conductive foam strip 6.

The height of the table 9 above the rubber strips 5 should be sufficient to retain ball 11 in position, yet not allow it to slip under the bottom of the table 9 when the ball 11 is depressed, causing contact between strips 5 and 6.

It is preferred that the conductive rubber strips and the conductive foam strips be separated from their neighbouring parallel strips by a distance sufficient as to leave a gap therebetween greater than the diameter of the ball. Once the game has concluded by which all required balls are in position within correspondingly numbered holes 10, or at the beginning of a game after the board, has been checked with all balls in position, the table top is shifted and the balls are moved by the table to adjacent gaps between strips 5. The balls then fall through between both the rubber and foam strips into a sink or similar container. The table is then allowed to shift back to its previous position, typically by means of a spring.

The sink or similar container can be of any known form, such as that portion shown below table top 4 in FIG. 1 designated by reference numeral 13. The sink normally has an exit into a ball retaining blowing chamber.

The shifting of the table top is implemented by means of guides at opposite sides thereof of a well-known form.

In FIGS. 3A and 3B the ball 11 is shown as being in holes which are immediately above gaps between each conductive foam strip 6 and insulating strip 7. In this form of the invention to release the balls table 9 will be moved in a direction parallel to foam strips 6. The balls are therefore moved orthogonal to rubber strips 5 and thereby slip therebetween, and into the gaps at the sides of conductor foam strip 6.

However, the holes 10 in table 9 can be located more directly over the foam strips 6 in another embodiment which will allow a smaller degree of depression of the strip to be required when contact between the strips is to be made.

In the latter case, the table will be caused to move in a diagonal direction when the balls are to be released, in order to orient the balls over the gaps between conductive and foam strips 5 and 6.

It should be noted that it is contemplated that the stips described above as fabricated out of conductive foam may instead be made of other material, such as brass, aluminum or other conductive material. In this case the sharp edges which may be encountered in a hard material such as conductive aluminum should not face the rubber strip 5 where the contact is to be made. The fringe edge of the hard material should be shaped as rounded or otherwise chamfered. In this way abrasion of the underside of the rubber strip 5 will be minimized. Of course where a conductor such as aluminum is used, foil strips 8 need not be incorporated, as terminals to each row or column can be directly applied.

It is also contemplated that the conductive strip 5 not necessarily be made of rubber. Other materials such as conductive foam can be used. Nevertheless in the preferred embodiment, the upper strip is preferred to be of conductive flexible resilient material and the lower strip to be of conductive yieldable resilient material.

Figure 4A:
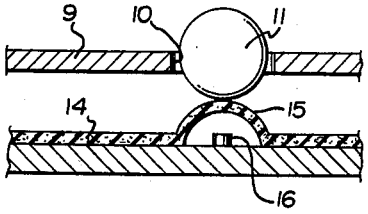
FIGS. 4A and 4B are elevation views in section of a second embodiment of the inventive switch.
Figure 4B:
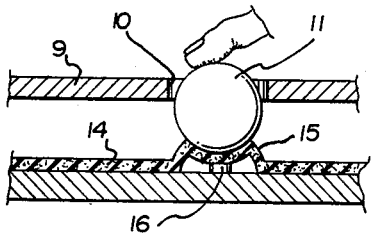

Another embodiment of the invention is shown in the section in FIGS. 4A and 4B. In this case, a plurality of spaced parallel conductive flexible strips 14 are fixed or are otherwise adherent to an insulating support 15. The strips are dimpled upwardly so as to form dimples 15 across the width, for example following the shape of the wall segment of the cylinder.

As with respect to the earlier described embodiment, a table 9 is located above the strips 14. In this case, however, holes 10 are located in the table immediately above each of the dimples 15. The table 9 is located sufficiently above the top of the dimples 15 so as to support balls 11 both vertically and laterally within each hole by means of the sides of the hole and the top of each dimple 15. Yet the table should not be so high that the ball 11 will slip beneath the bottom of the table 9 when the ball is pushed downwardly, compressing the dimple to the insulating support.

Conductive terminals 16 are located below the dimple, preferably fixed to support 15. Accordingly, when a ball 11 is pushed downward, the dimple of the conductive strip 14 is caused to make contact with terminal 16.

Preferably, the dimples are lined up, in order that rows and columns of dimples be formed. Wires preferably interconnect each terminal 16 in a row or column orthogonal to strips 15, located below the bottom surface of the dimples. A terminal for connection to an electronic circuit is connected to the end of each of the wires of a particular row or column connecting each of the terminals under each of the dimples of a row or column. Similarly, terminals are connected to the ends of each of the column or row constituted by each strip 14.

With this structure, the wires need not follow straight lines interconnecting each of the terminals 16 in a row or column, but may curve so as to allow room for the ball to fall between strips 14. However, should there be sufficient distance between the wires and the bottom of table 9 to provide clearance for a ball, between strip 14, the wires may follow straight lines as a ball will not balance on the edge of the wire, but will fall on either side and further between the wires. Sufficient space must be left between the wires, and also between each of the strips 14 to accommodate at least the diameter of the balls without interference, and to thus allow all of the balls to fall into a sink located therebelow.

Of course in both embodiments, the lower metallic or other material strips can be of other forms than of common dimension. For instance the lower strips can be wider under the upper strips where contact is to be made, and narrower between the upper strips.

Figure 5:
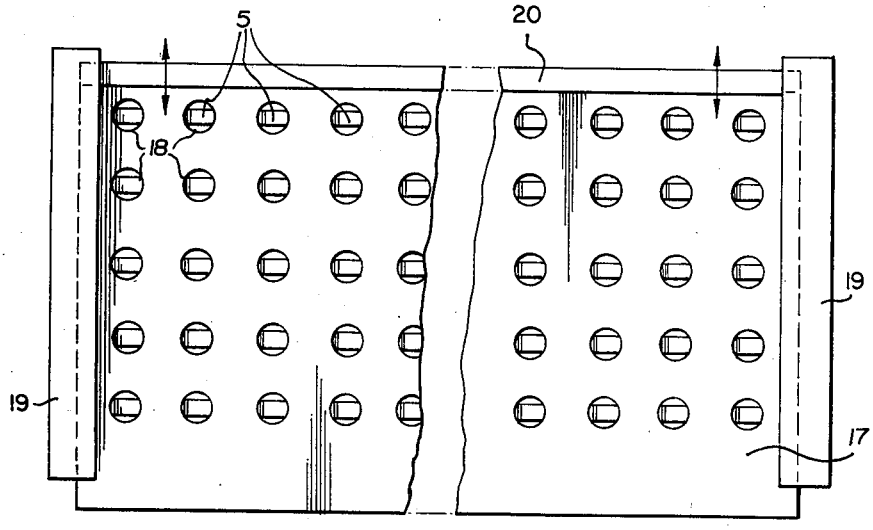
FIG. 5 is a plan view of the game table top.

FIG. 5 shows a plan view of the table. The table 17 contains a plurality of holes 18 for accommodation of the balls of a game. Each of the holes is preferably numbered (not shown).

At the sides of the table are guides 19 of well known construction to accommodate sliding forward and backward of the table 17. Preferably the table is spring loaded to locate it in a rest position by which the holes are directly over the locations as described above for depressing the conductive rubber strips and making contact with the underlying conductive strips. In FIG. 5, conductive rubber strips 5 are visible through holes 18.

In operation, balls are placed in holes 18, and as each one is placed in its hole, it is depressed momentarily. An electronic circuit connected to the terminals of the rubber strip of the row which is depressed, and the terminals of the column of the foam strip to which contact is made registers which point of the matrix of potential contacts has been made, and translates this to an illuminated light bulb on a display board, behind the appropriate number which has been called, by circuitry which is not the subject of this invention.

Once all of the numbers have been called to complete a game, the table 17 is pushed forward against the aforenoted spring tension, until contact is made with a backboard 20. The balls which had been over conductive rubber strips 5, have now been moved together over gaps between the strips, and they fall through the gaps to a sink below. Once the balls have fallen, the table 17 is allowed to be restored to its normal rest position with holes 18 over conductive rubber strips 5 by action of the aforenoted spring.

It will be understood a person skilled in the art reading this specification may now design other embodiments of the invention using the principles described. All are considered within the scope of this invention as defined in the appended claims.

The embodiments of the invention in which an exclusive property or privilege is claimed are defined as follows:

1. A game switch matrix comprising:

(a) a plurality of first spaced parallel strips of conductive, flexible resilient material, (b) a plurality of second spaced parallel strips of conductive material disposed orthogonal to, below, in a plane parallel to, and spaced from the first plurality of strips, (c) means for supporting the first plurality of strips, said supporting means being comprised of insulators of unyieldable material having a first strip supporting surface which is higher than the upper contacting surface of the second strips, disposed along lines parallel to each strip of the second plurality of strips, providing an insulating air gap between the first and second plurality of strips, whereby, upon depression of one strip of said first plurality of strips at a point adjacent one strip of said second plurality of strips, said one strip of the first plurality of strips is caused to pass through said air gap and make electrical contact with said one strip of the second plurality of strips, and said one of said first plurality of strips is restricted from contacting any other of said second plurality of strips, (d) a table overlying the top of the first plurality of parallel strips, the table containing holes over said first strips to accommodate balls for depression of said one strip of the first plurality of strips, (e) the strips being spaced leaving gaps between each of said first strips and gaps between each of the second strips, the gaps having their narrowest dimension larger than a predetermined diameter, further including means for allowing the table to be shifted to orient the holes over said gaps, so as to shift any playing balls which may be inserted by a player within said holes to positions over said gaps and thereby allow them to fall through said gaps, and further including a sink disposed below said plurality of said second strips having a ball channelling outlet leading to a ball containment chamber.

2. A game switch as defined in claim 1 in which the second strips of conductive material are comprised of yieldable resilient material.

3. A game switch matrix comprising:

(a) a plurality of first spaced parallel strips of conductive, flexible resilient material, (b) a plurality of second spaced parallel strips of conductive, yieldable, resilient material disposed, below, in a plane parallel to, and air spaced from the first plurality of strips, said second strips including thin strips of conductive metal running orthogonal to the first plurality of strips and contacting said second strips, (c) means for supporting the first plurality of strips comprising insulating strips of unyieldable material having a first strip supporting surface which is higher than the upper contacting surface of the second strips, disposed and running alongside the side of each strip of the second plurality of strips, whereby, upon depression of one strip of the first plurality of strips at a point adjacent one strip of the second plurality of strips, said one strips are caused to make electrical contact, and said one of said first plurality of strips is restricted from contacting any other of the second plurality of strips, and (d) a table overlying the top of the first plurality of parallel strips, the table containing holes adjacent the intersection of each of the first and second plurality of strips directly over each of the first strips, but offset from locations directly over the strips of unyieldable material, for accommodating balls for depression of said one strips.

4. A game switch as defined in claims 1, 2 or 3 in which the strips are spaced, leaving gaps between each of said first strips and gaps between each of the second strips, the gaps having their narrowest dimension larger than the diameter of a playing ball to be inserted in each of said holes, further including means for allowing the table to be shifted to orient the holes over the gaps between said first and second strips, so as to shift balls which may be loosely supported within the said holes to positions over said gaps and thereby to allow them to fall through said gaps.

5. A game switch matrix as defined in claims 1 or 3, in which each of the holes is of predetermined diameter, the lower edge of the holes being spaced from the first strip a distance significantly less than said diameter when said first strip is depressed.

6. A game switch as defined in claim 1, 2 or 3 in which the first strips of material are fabricated of conductive rubber and the second strips of material are fabricated of conductive foam.

7. A game switch as defined in claim 2 or 3 in which the first strips of material are fabricated of conductive rubber and the second strips are fabricated of metal.

8. A game switch matrix as defined in claims 1, 2 or 3 in which said insulators are comprised of a plurality of insulative rods located between said holes and between the first and second plurality of strips, running orthogonal to the direction of the first plurality of strips.

* * * * *